US006560842B1

(12) United States Patent
Kusel et al.

(10) Patent No.: US 6,560,842 B1
(45) Date of Patent: May 13, 2003

(54) METHOD OF MANUFACTURING A DELI-STYLE DISPLAY CASE

(75) Inventors: Richard D. Kusel, Spartanburg, SC (US); Harry A. Brancheau, Inman, SC (US)

(73) Assignee: Specialty Equipment Companies, Inc., Aurora, IL (US)

( * ) Notice: Subject to any disclaimer, the term of this patent is extended or adjusted under 35 U.S.C. 154(b) by 0 days.

(21) Appl. No.: 09/575,851

(22) Filed: May 19, 2000

Related U.S. Application Data

(60) Provisional application No. 60/134,831, filed on May 19, 1999.

(51) Int. Cl.[7] ..... B65D 6/10; B65D 6/40; B65D 6/28; A47B 96/04

(52) U.S. Cl. ..... 29/455.1; 29/530; 29/469.5; 264/DIG. 83; 62/253; 312/140; 312/406; 220/682; 220/690; 220/592.25; 220/FOR 156

(58) Field of Search ..... 29/455.1, 460, 29/469.5, 505, 530; 264/478, DIG. 83; 62/246, 251, 253, 447, 518; 211/85.26; 312/114, 116, 140, 400, 401, 406; 220/682, 689, 690, 592.25, FOR 156

(56) References Cited

U.S. PATENT DOCUMENTS

| | | | | |
|---|---|---|---|---|
| 2,522,097 | A | * | 9/1950 | Cookson |
| 3,520,581 | A | * | 7/1970 | Borghi |
| 3,601,463 | A | * | 8/1971 | Watt |
| 3,632,012 | A | * | 1/1972 | Kitson |
| 3,794,396 | A | * | 2/1974 | Vick |
| 3,948,410 | A | * | 4/1976 | Anderson |
| 4,040,166 | A | * | 8/1977 | Morphy |
| 4,044,449 | A | * | 8/1977 | Phan |
| 4,082,825 | A | * | 4/1978 | Puterbaugh |
| 4,135,369 | A | * | 1/1979 | Allgeyer et al. |
| 4,750,335 | A | | 6/1988 | Wallace et al. |
| 4,891,912 | A | * | 1/1990 | Bockwinkel |
| 4,920,696 | A | * | 5/1990 | Mawby et al. |
| 4,941,327 | A | * | 7/1990 | Miles |
| 5,199,778 | A | * | 4/1993 | Aoki et al. |
| 5,606,863 | A | | 3/1997 | Kicklighter et al. |
| 5,908,229 | A | * | 6/1999 | Wetherholt et al. |
| 5,964,512 | A | * | 10/1999 | Borgen |
| 6,185,951 | B1 | * | 2/2001 | Lane et al. |
| 6,238,032 | B1 | * | 5/2001 | Cooper et al. |

FOREIGN PATENT DOCUMENTS

FR 2562646 * 10/1985

OTHER PUBLICATIONS

Phoenix High Volume Bakery Merchandiser Catalog Sheets, Arneg, Inc., Nazareth, PA, Aug. 1997, 2 pages total.
Horizontal Display Cases (Deli Line) Sales Brochure, Beverage–Air, Spartanburg, SC Dec. 1997, 2 pages total.
Curved Glass Hot Deli Case Model CG–4HD Sales Brochure and Price List pp. 5 & 6, Federal Industries, Belleville, WI, 1997, 4 pages total.
Lift–up Curved Glass Deli, Meat and Seafood Cases Sales Brochure, Hill Refrigeration, Trenton, NJ, undated, 2 pages total.
Cake Decorating Cases Sales Brochure, Refcon, W. Haverstan, NY, undated, 2 pages total.
Curved Glass Display Case Series 500 Sales Sheet, Idelfield, Mt. Pleasant, MI, Apr. 15, 1997, 1 page.
Randall Merchandisers 40000, 4000A Series Catalog pages, Randall Manufacturing, Inc., Weidman, MI, pp. 26, 28, & 29, Jan. 1, 1996.
Deli Cases Model TSID–48–2 Sales Brochure, True, undated, 2 pages total.
Curved Glass Marketeer Specification Sheet, Beverage–Air, Spartanburg, SC, hand dated May 17, 1999, 1 page total.

* cited by examiner

*Primary Examiner*—Gregory Vidovich
*Assistant Examiner*—Eric Compton

(57) ABSTRACT

The present invention provides an improved method of constructing a food display case. The construction techniques make use of a crimping tool which stitches together overlapping metal flange portions of the component display panel. The resulting stitched seams permit the rapid assembly of the non-glass structural components. In situ foaming of the spaces between the interior and exterior display walls, floor panels, and top panels, provides a rigid spaced connection between the adjacent panels and provides for the overall rigidity and increased strength of the resulting display case.

1 Claim, 14 Drawing Sheets

METHOD OF MANUFACTURING A DELI-STYLE DISPLAY CASE

RELATED APPLICATION

This application claims the benefit of U.S. Provisional Application Ser. No. 60/134,831 filed May 19, 1999 and which is incorporated herein by reference.

BACKGROUND OF THE INVENTION

1. Field of the Invention

The present invention relates generally to commercial food display cases of the type commonly found in supermarkets and similar establishments. In a more particular sense, the application is directed towards cases of the type described in which the front of the case is closed by a display window and access to the case is normally made through rear doors. Cases of this type are in widespread use for marketing of service meats, cheeses, prepared foods, and other products that must be sliced or otherwise prepared according to the retail food customer, as well as for marketing other products such as delicatessen items and fresh food.

More particularly, the field of the invention is directed towards a method of manufacturing a display case which may be refrigerated, heated, or "dry", i.e., lacking any temperature regulating apparatuses.

The display cases of the type described above are widely used within the retail food industry. When the cases are designed for either hot or cold food displays, it is desirable that the display cases be provided with good thermal insulation properties. Accordingly, it is necessary to provide a central food display compartment which is surrounded as completely as possible by a thermal barrier including insulation along the non-glass walled surfaces of the display case.

While it is known in the art to provide standard insulation materials within the wall spaces which are opposite the display enclosure, there remains room for variation and improvements in the manufacturing process which simplifies the manufacturing process and enables a more efficiently constructed display case which makes use of less labor-intensive methods.

Typically, the structural walls, top, and bottom of a display case of the present type make use of metal panels which are fastened together with sheet metal screws or other separate fasteners. As the panels are constructed, insulation in a form of fiberglass batts or sheets or foam is placed within the panels to provide thermal insulation for the non-glass components of the display case. While the use of in place foamed insulation is known within the art, the methods of constructing a display case having foamed in place urethane insulation have changed little. The conventional teaching provides for the of construction of a rigid metal display unit which then undergoes a foaming step between the inner and outer frame walls surrounding the food enclosure.

However, there has been no suggestion in the art which takes advantage of the adhesive and rigidity properties of a single unitary network of cured foam which allows a construction method which can eliminate certain interconnective steps and attachment parts typically used to construct the display case. As a result, the components may be redesigned to have simple overlapping flanges and avoid the need for special tooling or parts. Accordingly, there remains room for improvement and variation within the art of display cases and methods of their construction.

SUMMARY OF THE INVENTION

The present invention provides an improved method of constructing a food display case. The construction techniques make use of a crimping tool which stitches together overlapping metal flange portions of the component display panel. The resulting stitched seams permit the rapid assembly of the non-glass structural components. The resulting display frame, while self-supporting, lacks overall rigidity and possesses a great deal of play and flexibility. In situ foaming of the spaces between the interior and exterior display walls, floor panels, and top panels, provides a rigid spaced connection between the adjacent panels and provides for the overall rigidity and increased strength of the resulting display case.

As a result of the high strength bond provided between the foamed walls and panels, traditional and labor-intensive fasteners are not required to interconnect the panels. Rather, a rapid, less permanent connection is made followed by the in situ foaming of the panels. Once the foamed has cured, the insulating foam provides strength and support to the display structure.

DETAILED DESCRIPTION OF A PREFERRED EMBODIMENT

Figure 1:
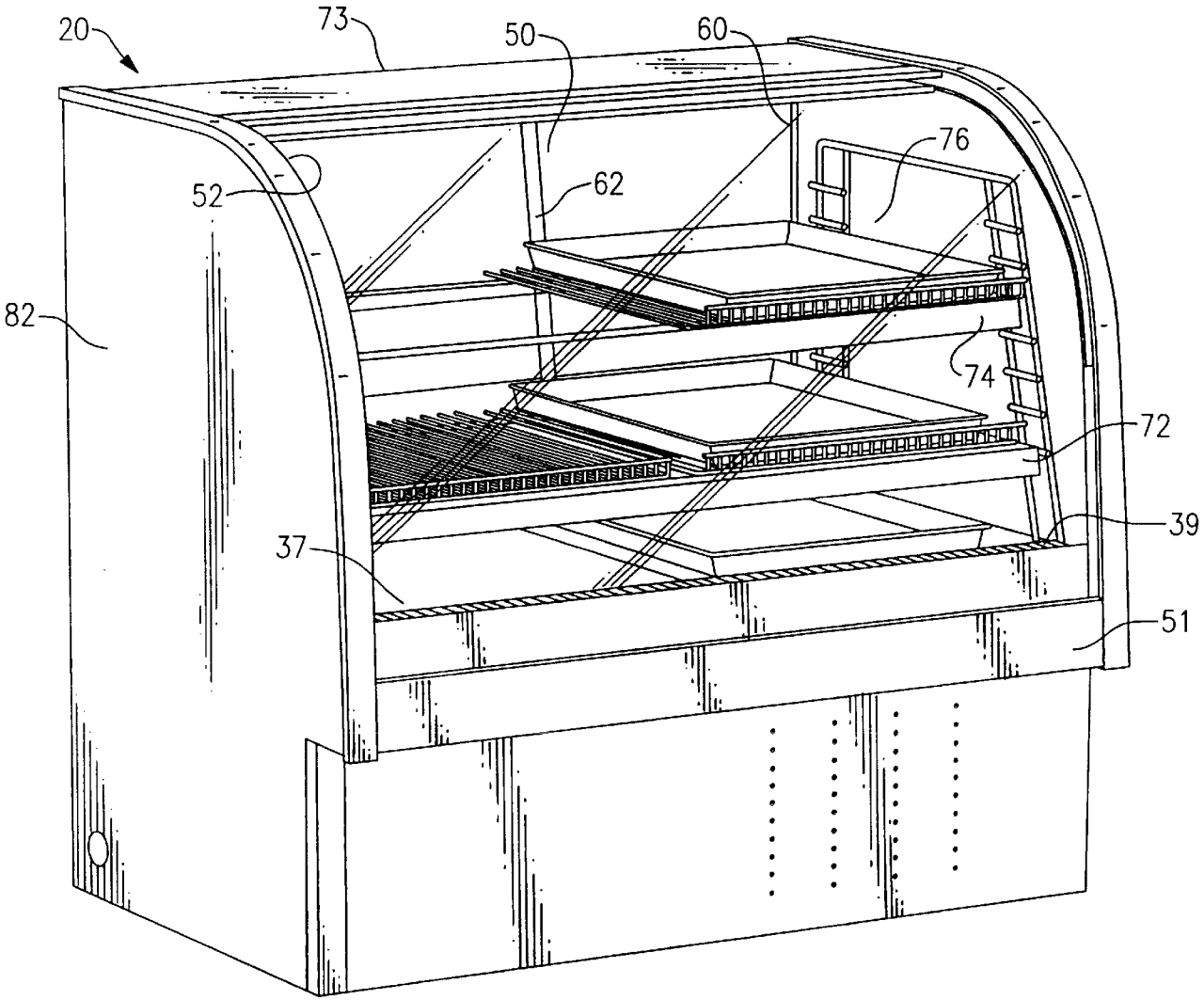
FIG. 1 is a front perspective view of a display case constructed according to the present invention.

It is to be understood by one of ordinary skill in the art that the present discussion is a description of an exemplary embodiment only, and is not intended as limiting the broader aspects of the present invention, which broader aspects are embodied in the existing construction.

With respect to the present invention, it is understood that an insulated enclosure such as the deli case may be constructed having either a conventional refrigeration unit for cold foods, a heating unit for hot foods, or having no environmental controls (dry). While the present embodiment is directed towards a refrigeration unit, similar construction techniques are used for a heated or a dry display case.

In describing the various figures herein, the same reference numbers are used throughout to describe the same apparatus or process pathway. To avoid redundancy, detailed descriptions of much of the apparatus once described in relation to a figure is not repeated in the descriptions of subsequent figures, although such apparatus or process is labeled with the same reference numbers.

Referring now specifically to the drawings, the display case 20 is shown to be of the deli refrigeration stock. The unit has a floor 30 (best seen in FIGS. 2A, 2B, and 3A), a pair of closed side walls 80 and 82, a front 51 including a transparent display window 50 having a convexly curved surface along the top, a rear wall 60 having a slidable window-type service door 62, and a top 73 positioned between the front 50 and the rear 60, all defining a food storage and display space 76. Doors 62 allow store personnel to place and remove food items with respect to the storage shelves 72 and 74 placed at the various vertically spaced heights within the case. Floor 30 may include suitable support legs 32 (FIGS. 3B and 4) in conventional fashion. A chamber 34 is defined between the floor 30 and display deck 37. This chamber 34 has a first airflow duct 39 along the lower edge of front wall 50 connecting space 76 and chamber 34. Duct 39 further defines a plurality of openings along the front of the deck.

Figure 9:
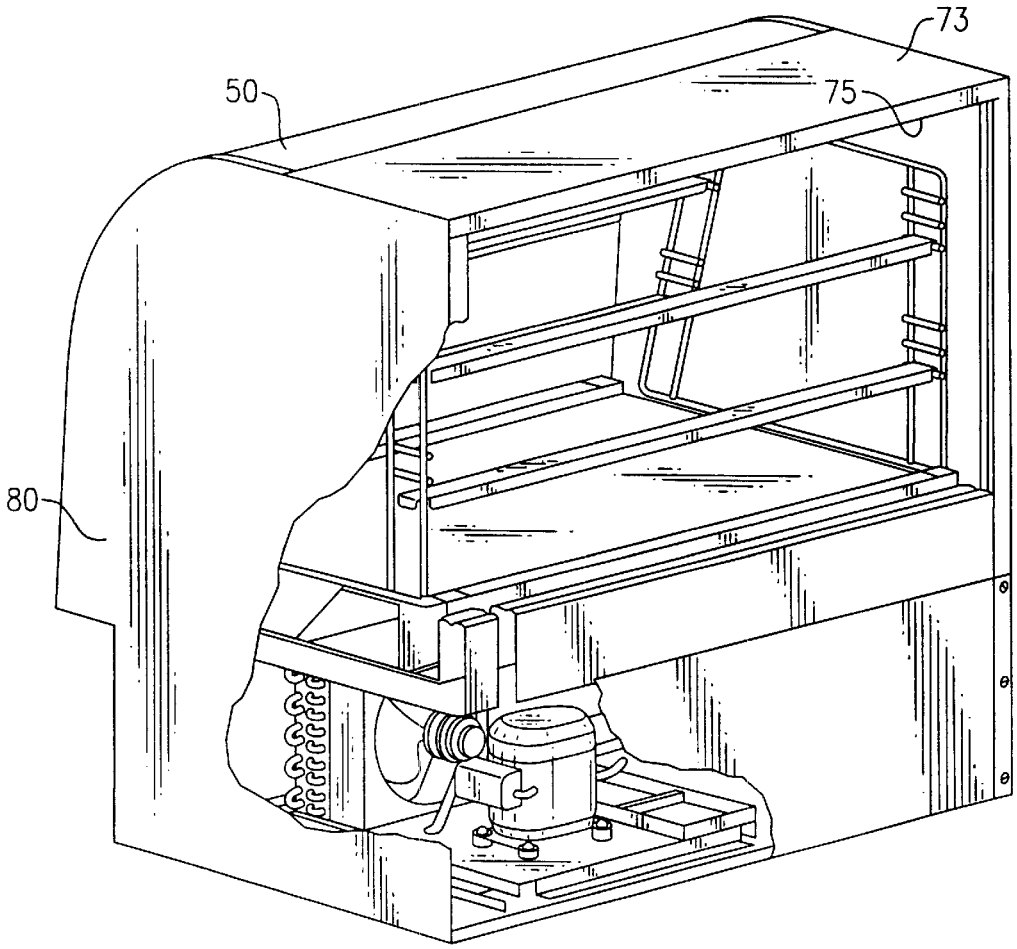
Figure 10:
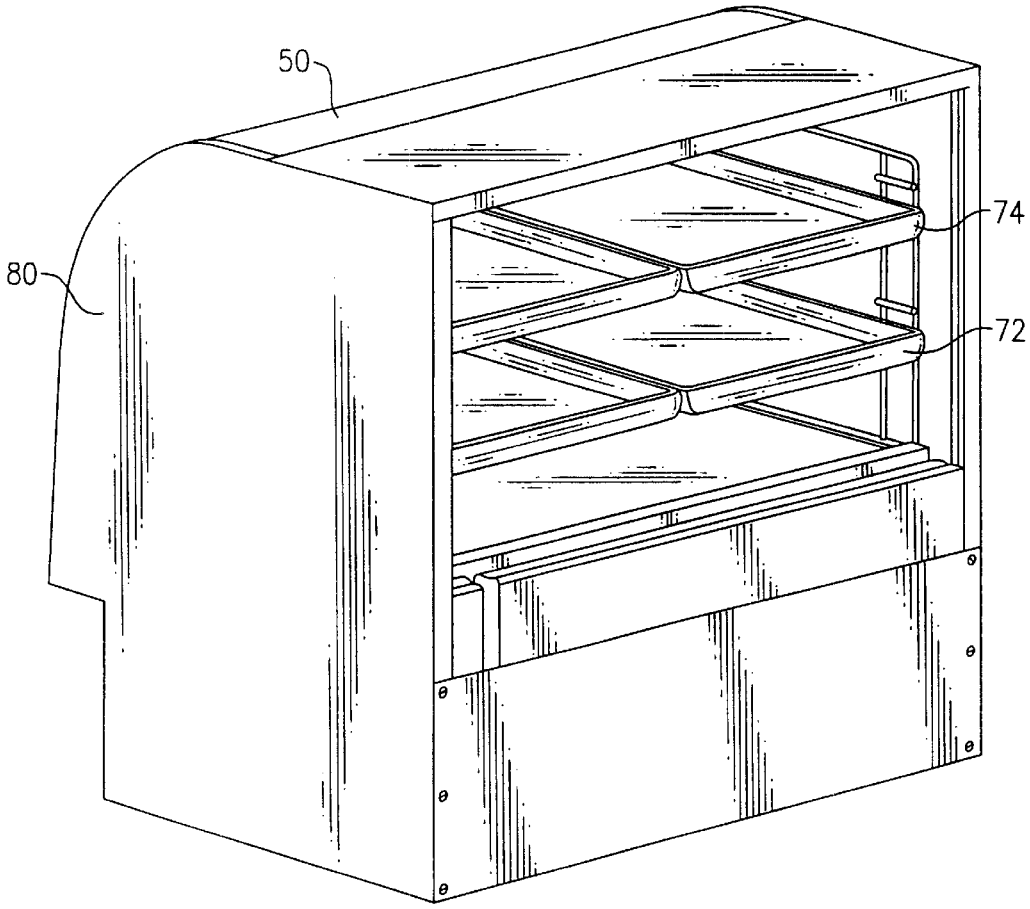

Within chamber 34 is at least one air propulsion motor driven fan 86 and a refrigeration coil 38 along the majority of the length of the case and which may require one or more coil units. Coil 38 is of the conventional evaporator type typically used in refrigerated display cases, conducting refrigerant through its tubing after the refrigerant is compressed, then cooled in a condenser, and then evaporated in the system to lower its temperature by loss of heat of vaporization. This is done by a conventional apparatus as seen in FIG. 9. This fluid cools the external circulating air passing through the coil. Airflow within chamber 34 is propelled by recirculation fans 86 through refrigeration coil 38 and indicated generally by directional arrows.

A second airflow duct 36 also connects space 76 and chamber 34, offset from first duct 39. Preferably, duct 39 is the inlet to chamber 34 from space 76, and duct 36 is the outlet from chamber 34 to space 76. Outlet 36 from chamber 34 extends along the base of rear wall 60 thereof and has its outlet oriented upwardly into space 76 to cause cold air to flow up across the inside surface of rear wall 60, i.e., the service doors 62, to the top 71 of the case where the air follows along the inside surface of the top 70 and is then deflected downwardly across the inside surface of the front display window 50, finally entering inlet 39 along the length of the base of window 50 through space between the outer ends of shelves 72 and 74 and window 50 to again be recirculated by fan 86 through coil 38 as previously noted. A small amount of the upflowing air on the way to top 71 may be diverted by a baffle below each of shelves 72 and 74 to help keep the shelves and food product cool and then rejoins the downflowing air adjacent the inside surface of window 50.

Conceivably, the recirculating air inside the cabinet could flow in the opposite direction of that shown by the arrows. In addition, additional fans could be placed within the airflow stream in either embodiment as well as providing baffles or accessory air chambers to direct the flow of chilled air in a preferred manner.

Figure 8:
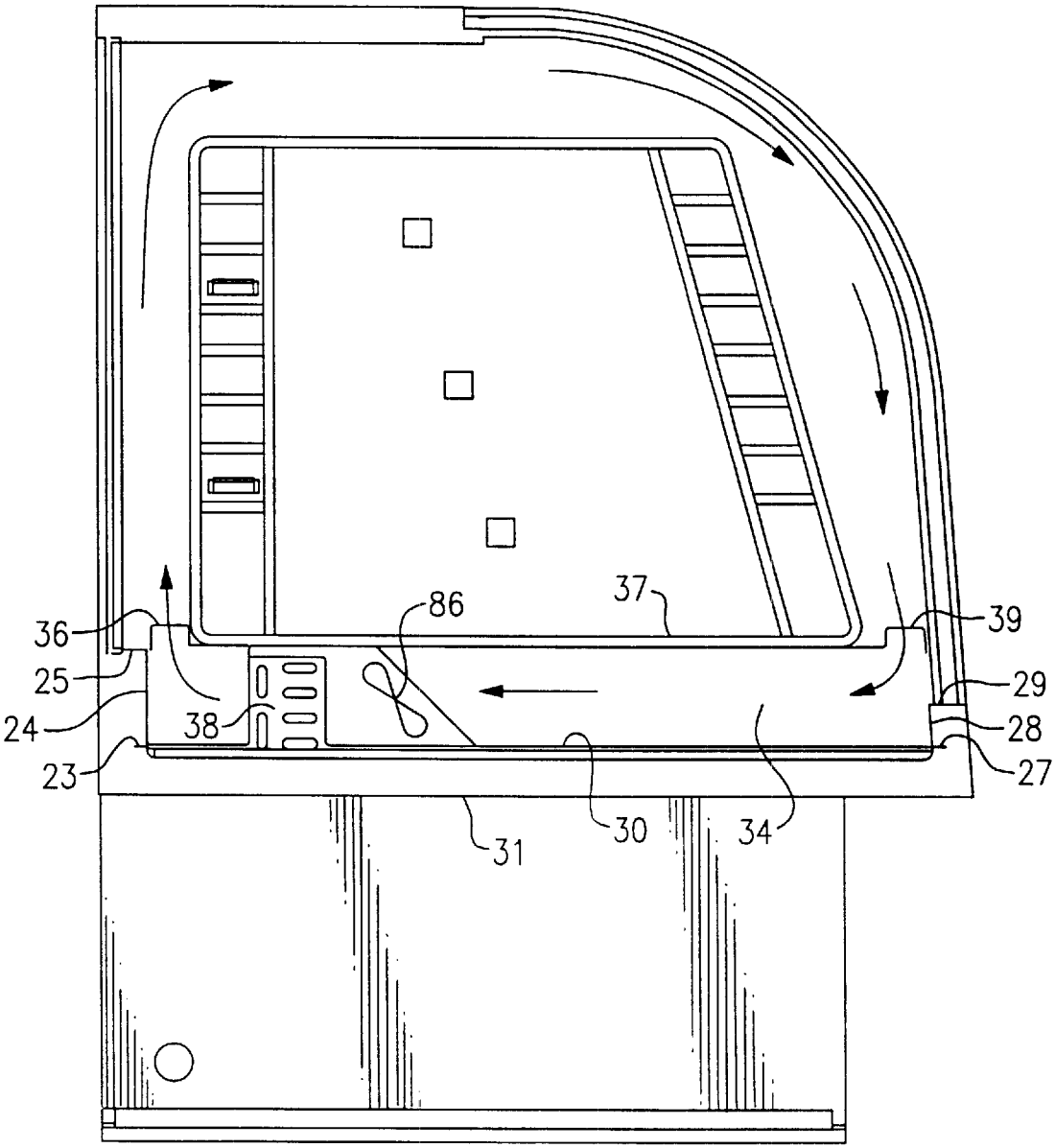

The case 20 is constructed according to the sequential steps set forth below as seen in reference to the figures. As seen in reference to FIGS. 2A, 2B and 8, a floor 30 is provided by a substantially flat metal sheet of conventional gauge and materials. Floor 30 is connected to a front connector piece 28 which generally defines a U-shaped channel having an upper flange 29 and a lower flange 27, flanges 29 and 27 extending outwardly toward the front of the display case. Lower flange 27 overlaps a front edge of floor 30 and are secured together by a stitching tool (TAGGER® 320 BY Attexor Equipments, Springfield, Mass.) which operates by the formation of a common aperture and staple being formed between two overlapping portions of metal. As best seen in reference to FIG. 3B, a sectional view through a stitched seam illustrates the aperture formed and the resulting crimping (staple) which occurs between the adjacent edges of the overlapping metal flanges. The aperture edges of one portion of the metal overlap the adjacent rim and provides a securing mechanism which holds the overlapping portions together. The stitched areas are indicated in the figures by a series of "x" markings.

Figure 2A:
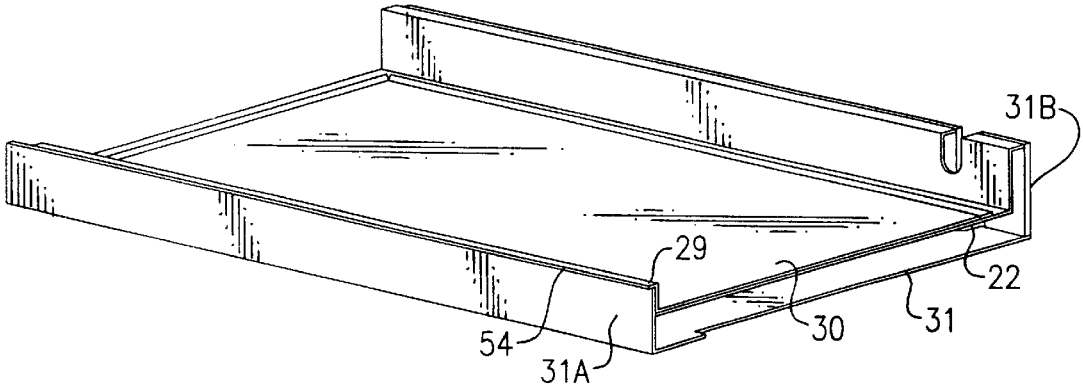
FIGS. 2–11C are perspective views showing the sequential steps of assembling the display case seen in FIG. 1 along with details of various component parts used in the case assembly.
Figure 2B:
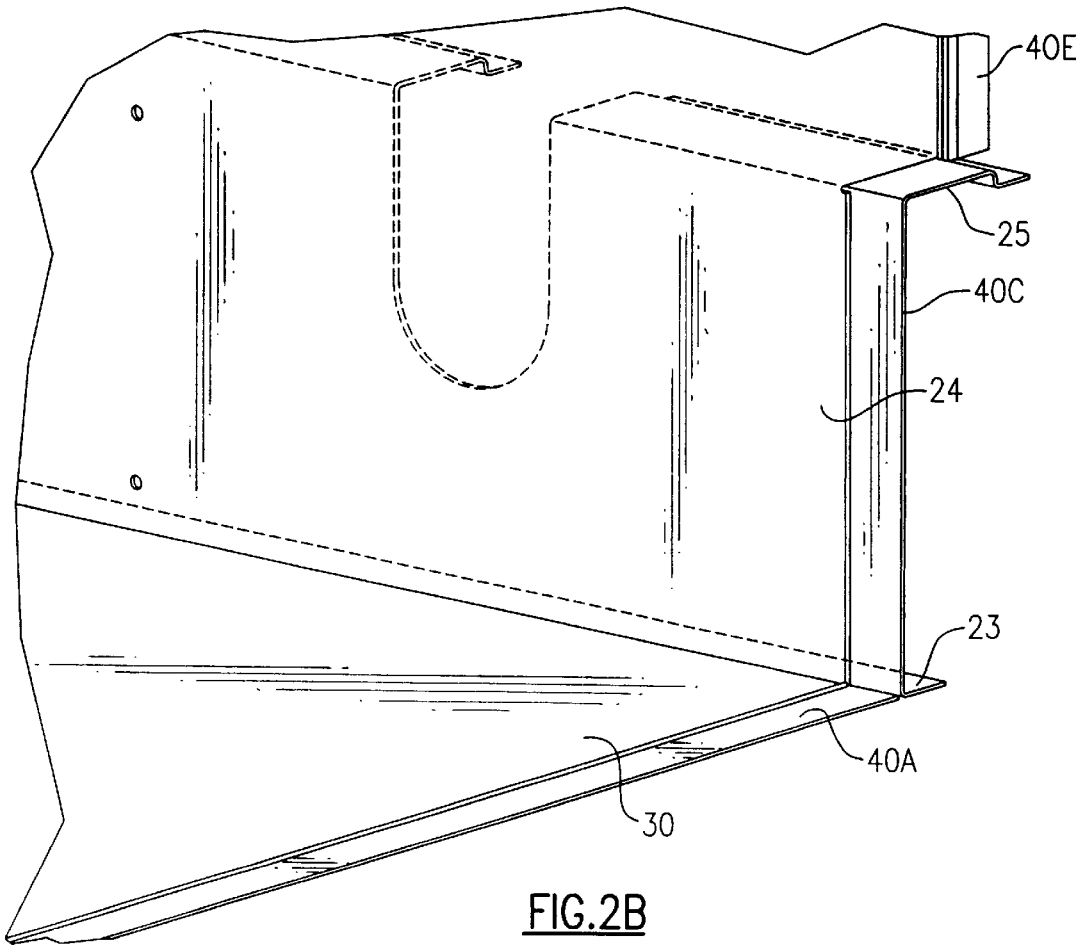

As best seen in reference to FIG. 2B, a rear piece 24 generally defining a U-shaped channel is secured to a rear of floor 30. Rear piece 24 has a lower flange 23 and an upper flange 25, flanges 23 and 25 extending outwardly from the rear of the display case. Lower flange 23 is stitched to the overlapping rear edge of floor 30 similar to the attachment of the front piece 28 to floor 30.

As seen in reference to FIG. 2A, a subfloor 31 is positioned a spaced distance below floor 30. Subfloor 31 defines an integral bent nosepiece 31A extending along a front edge of subfloor 31. Subfloor 31 further defines an upwardly projecting rear edge 31B defined along the rear wall of subfloor 31. The front nosepiece 31A and rear edge 31B extend slightly beyond the respective front floor piece 28 and rear floor piece 24. An interconnecting H-shaped plastic breaker strip, shown generally as 54 (FIG. 3C), is used to secure upper flange 25 to nosepiece 31A along the respective opposing edges. A similar strip is placed along the overlapping rear flange edges thereby securing the subflooring 31 to floor 30. Floor 30 is maintained a predetermined spaced distance prior to foaming from subfloor 31 by positioning a plurality of foam blocks 22 which provide a thermal break between floor 30 and subflooring 31.

Figure 3A:
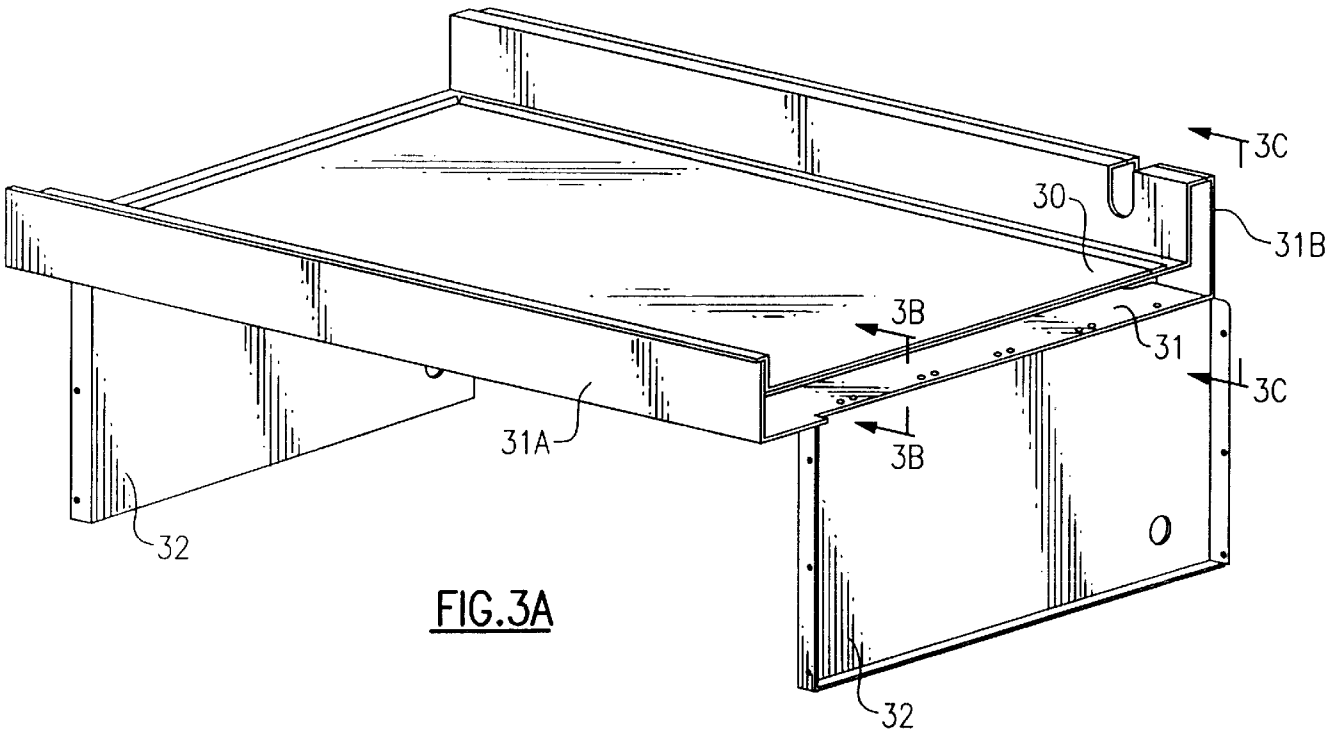
Figure 3B:
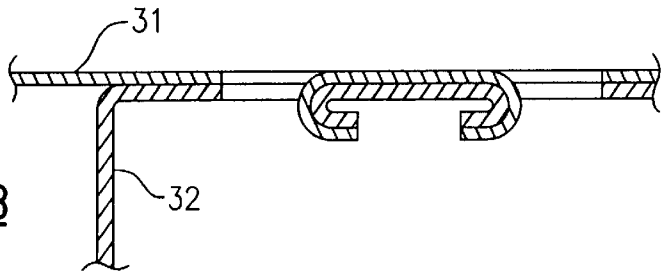
Figure 3C:
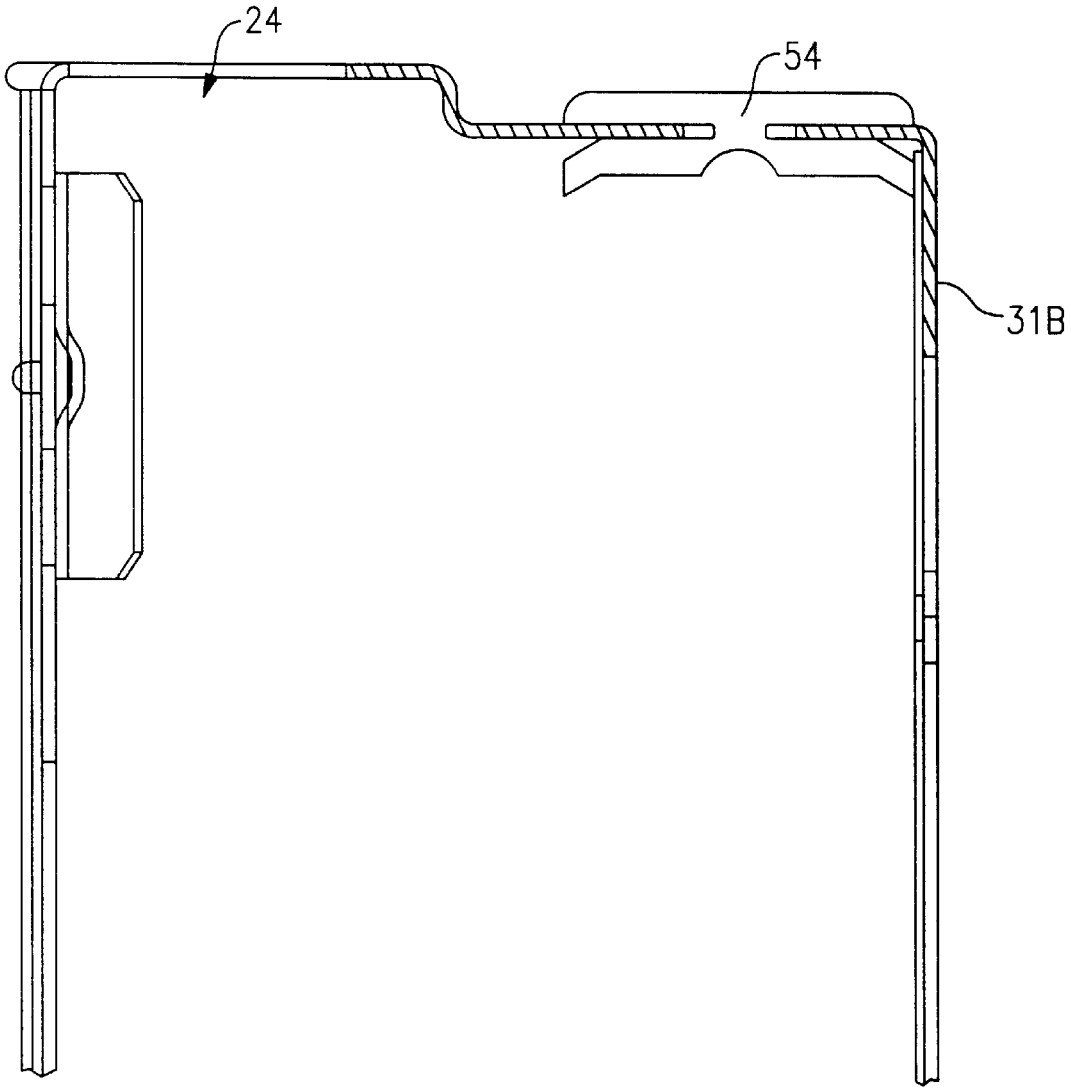

As seen in reference to FIGS. 3A and 3B, a pair of leg panels 32 are attached by stitches to subfloor 31 wherein a bent upper flange edge of the leg panel is stitched to a lower edge of subfloor 31.

Figure 4:
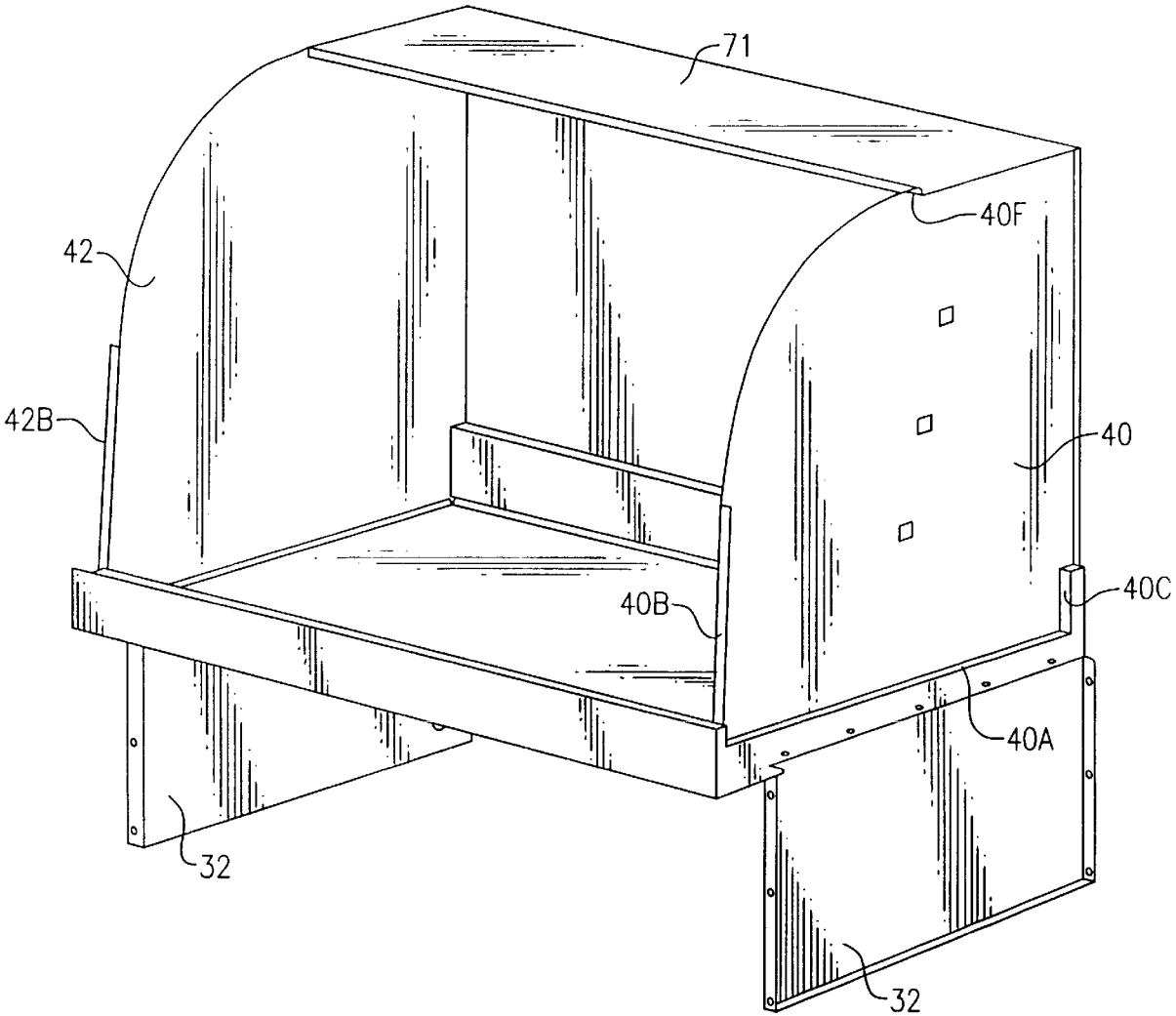
Figure 5:
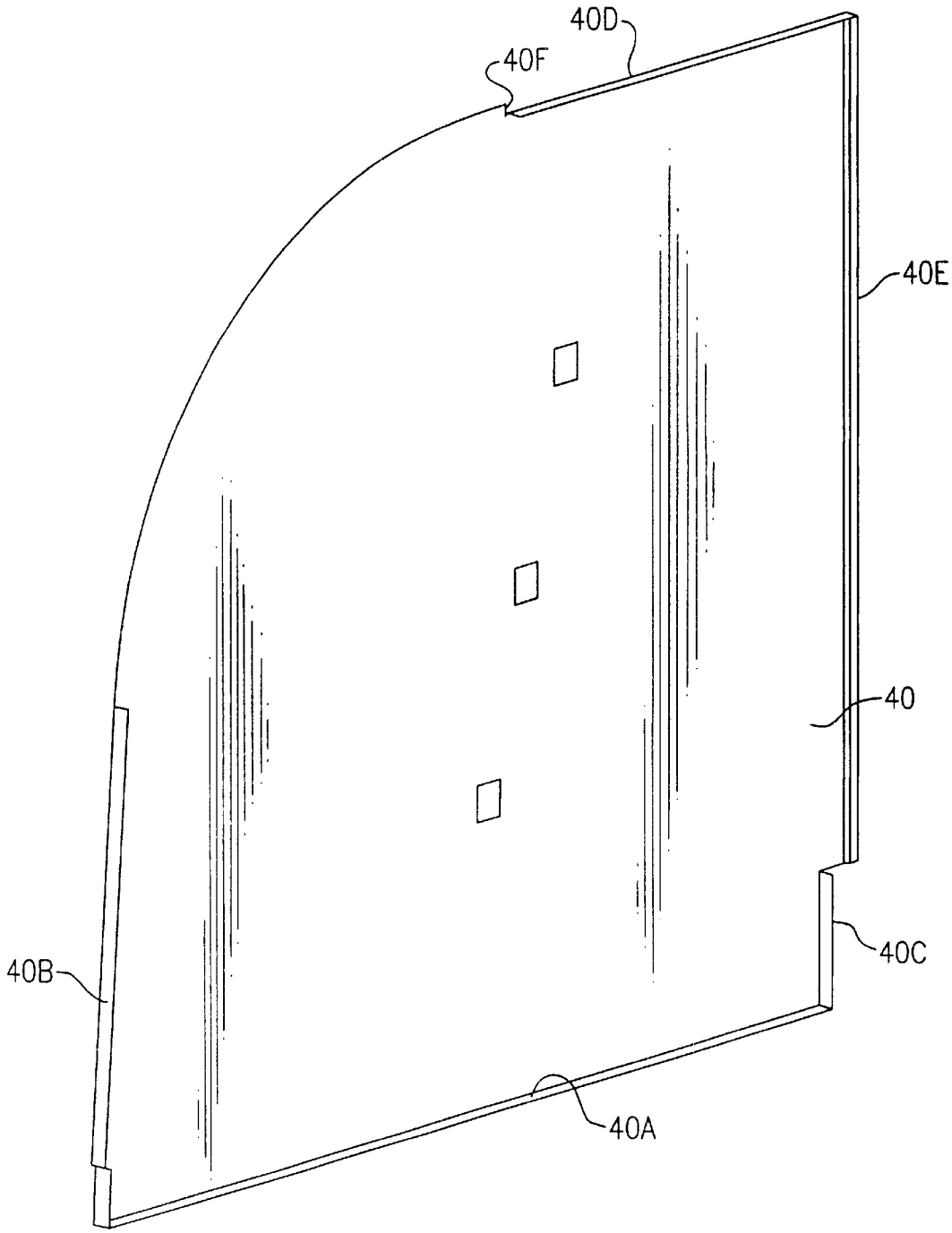

As seen in reference to FIGS. 4 and 5, interior side panels 40 and 42 are placed with a bottom flange edge of each panel engaging a respective edge of floor 30. As best seen in reference to FIG. 5, panel 40 (panel 42 being a mirror image thereof) defines a plurality of bent flanges which are adapted to engage and receive in a cooperative fashion adjacent frame member elements. Flanges 40*a* through 40*d* generally form approximate right-angled bends which are directed outwardly from the case interior. Flange 40*a* is stitched to an outer edge of floor 30. As seen in reference to FIG. 2B, the position and shape of the flange members 40*a*, 40*c*, and breaker strip 40*e*, are set forth, though the main body portion of panel 40 is not shown to better illustrate the nature of the overlapping flange elements and the stitched areas used to secure the components together.

As further seen in reference to FIG. 4, an inner top panel 71 is supported by the upper flange edges 40*d* and 42*d* and stitched along the flange and top panel overlap. A front edge of panel 71 defines a right-angled flange 78 which engages a notched shoulder 40*f* of panel 40. An upper panel 73, best seen in reference to FIGS. 6 and 7, defines a downwardly projecting front flange 79 along a front edge and additional downwardly projecting rear flange 75 along the rear edge. Upper panel 73 is positioned over the inner panel 71 and secured to outer panel 80 using sheet metal screws along aperture 77. As seen in FIG. 7, a spaced gap is provided between the front of flange 79 and the rear of flange 78. A foam block (not shown) is placed within the spaced gap, the foam block adapted for receiving the upper edge of the curved glass 50 and providing a seal with respect to an interior gap defined between upper panel 73 and inner panel 71.

Figure 6:
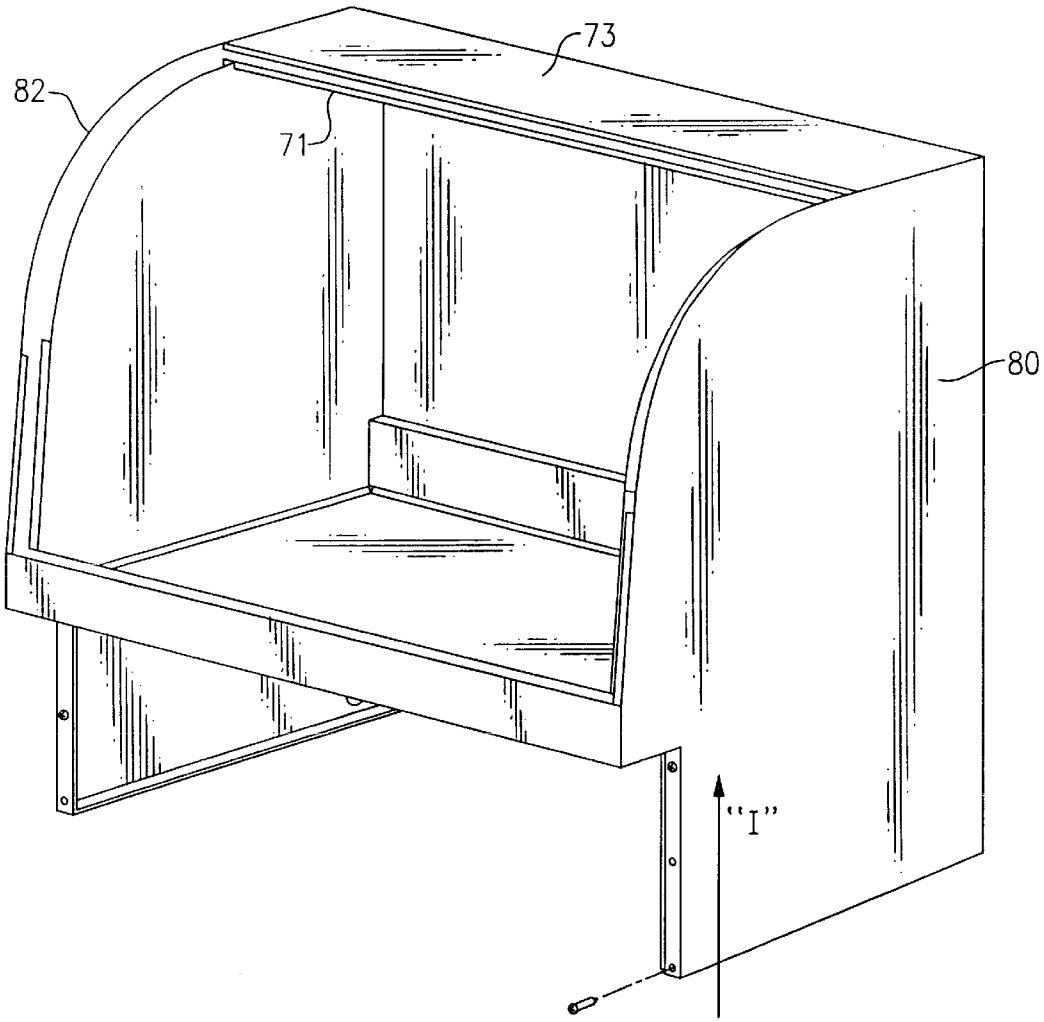
Figure 7:
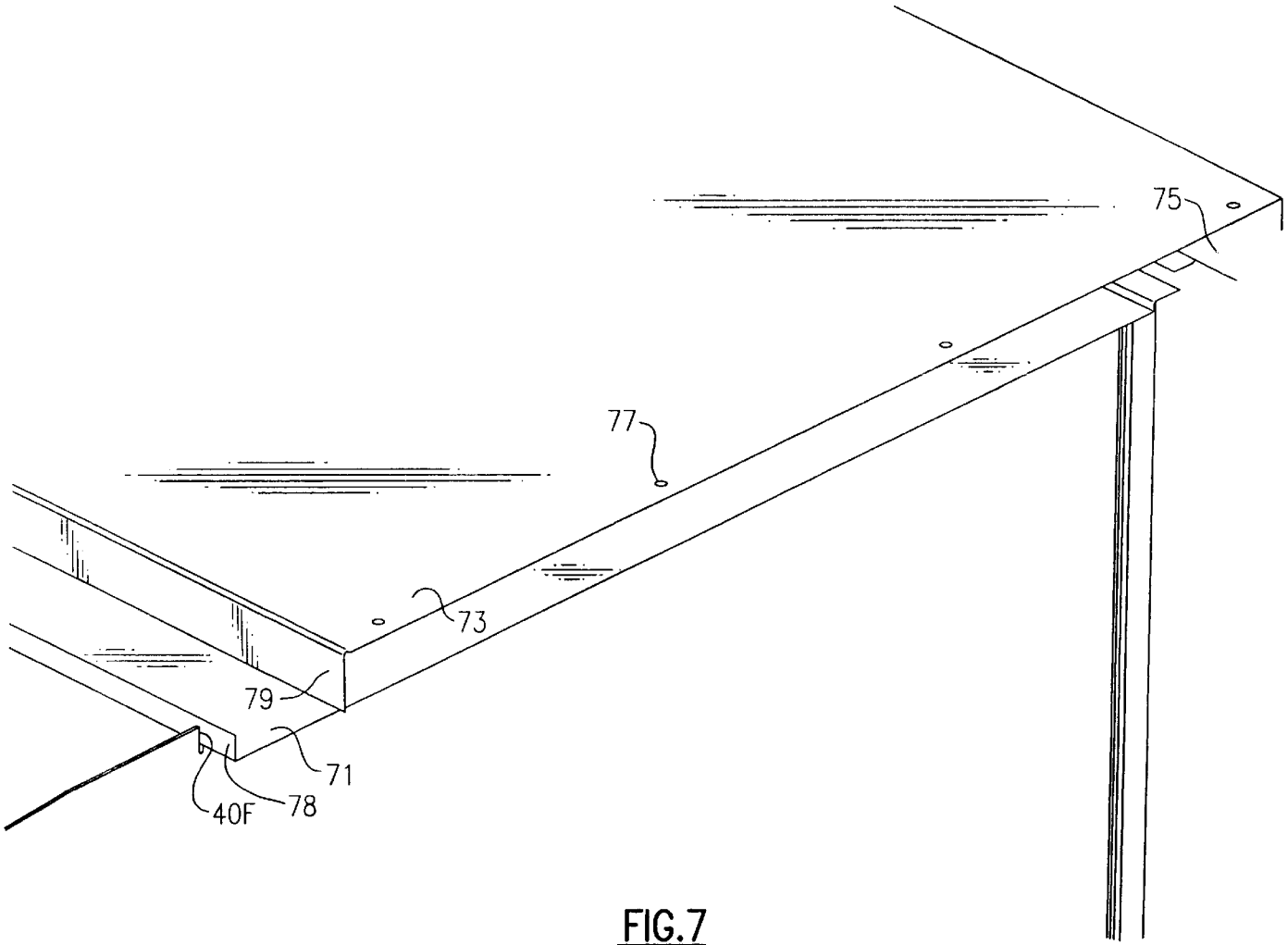
Figure 11A:
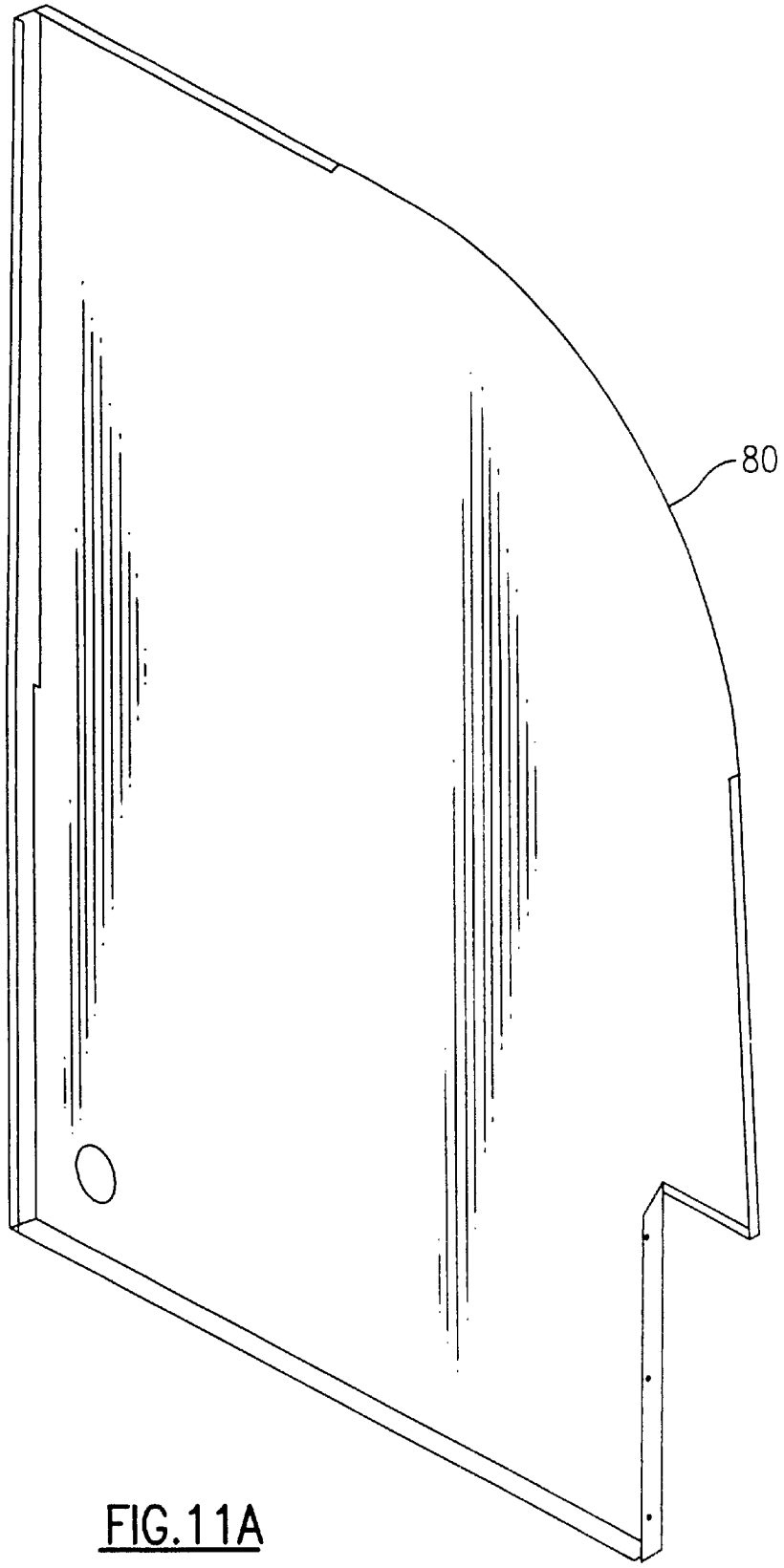
Figure 11B:
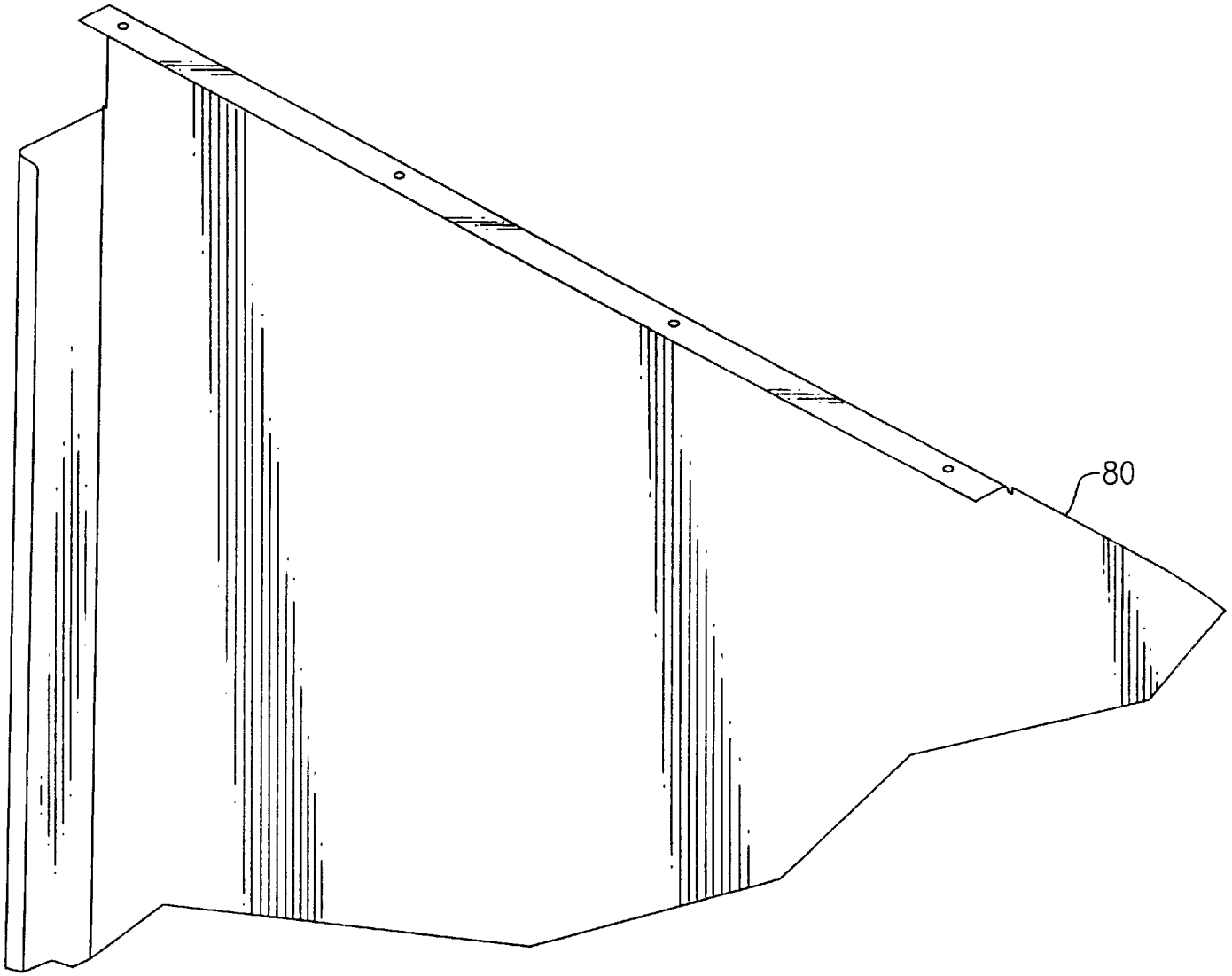
Figure 11C:
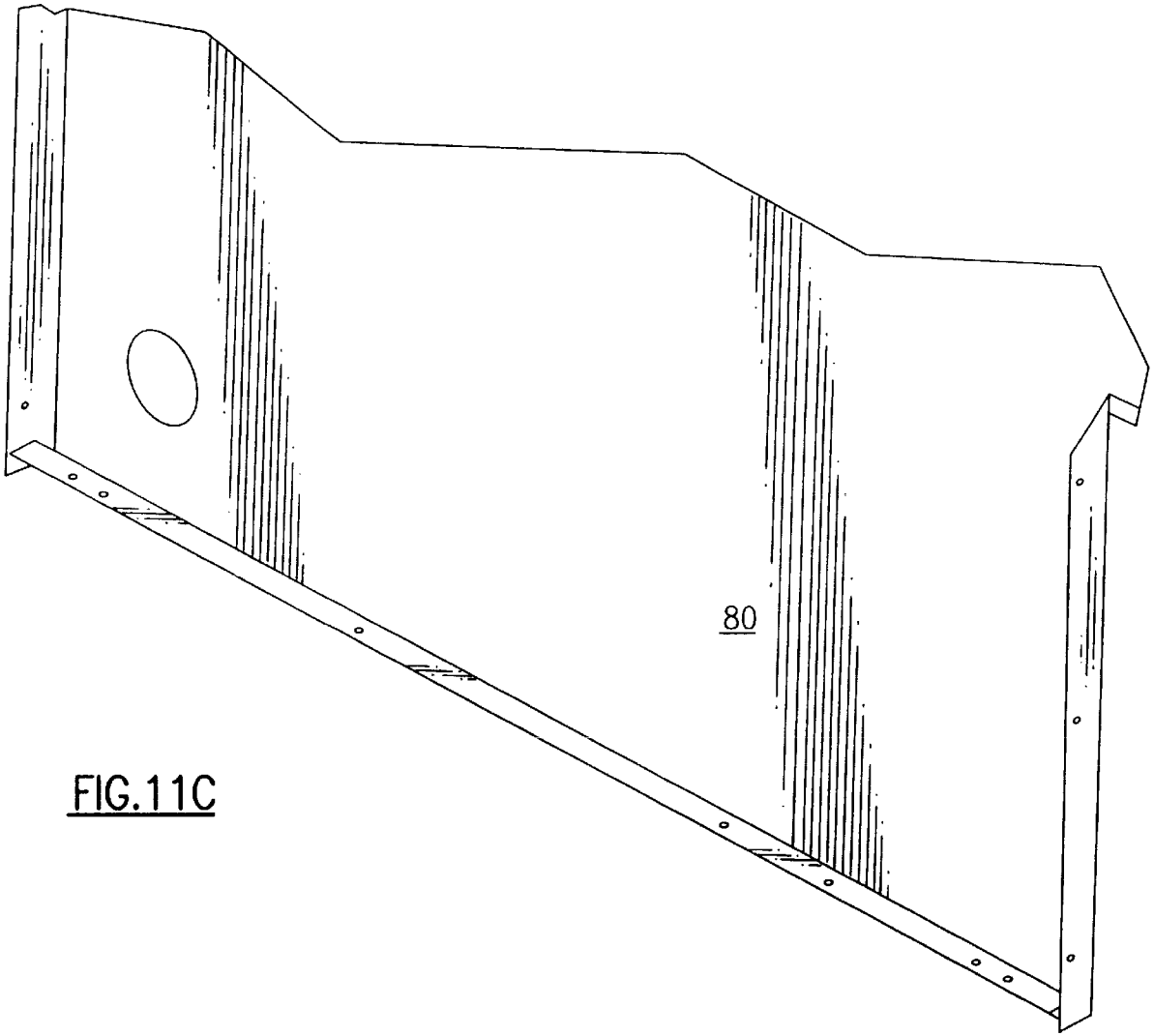

As seen in reference to FIGS. 6 and 11, exterior panels 80 and 82 are positioned against respective panels 40 and 42. Further, panels 80 and 82 have a lower portion which overlaps with the legs 32 of the display case.

As seen in FIG. 6, a spaced gap is defined between side panel 42 and exterior panel 82 and a similar gap is provided between side panel 40 and exterior panel 80. A similar continuous gap is provided between the exterior panel 82 and the leg panel 32. A foam spacer is positioned along the inner perimeter of panels 80 and 82 along the curved front edge walls.

The assembly steps to this stage result in a loosely joined structure with a great deal of flexibility and movement between the relative parts. The interstitched components, while lacking the necessary permanent strength and rigidity for a final end product, provide sufficient securement between the panels to maintain the desired structural placement. At this point, the display case frame is placed within a framework or blocking mechanism for securing the component parts in a proper fixed position prior to the in situ urethane foaming of the interior spaces. The spaces to be foamed include the interior gaps defined between: the interior walls 40 and 42 and respective exterior panels 80 and 82; leg panels 32 and respective exterior panels 80 and 82; top panels 71 and 73; and floor 30 and subfloor 31. A conventional blocking arrangement is used to maintain the respective panels in place during the injection foaming process.

As seen generally in the figures, the spaced gaps between the overlapping panel portions are in open communication with the gap portions defined by other panel pair members. To accomplish the continuous open gap regions between the various panel components, various notches or indentations are provided where needed to maintain an open pathway between the various gap portions.

The injection foaming step may be carried out with any conventional foam injection process including urethane foam. Useful attributes include a quick foam cure time, good foam flowability during the injection process, along with high strength and good thermal insulating qualities.

With respect to the present embodiment, the case assembly as seen in FIG. 6 is placed on its rear within a restraining block assembly. The urethane foam injection nozzle is inserted at locations within the space defined between an end panel 80 or 82 and a corresponding leg panel 32 and as further indicated generally by arrow "I" in FIG. 6. From these two injection points, the injected foam will migrate through the interconnected spaces referenced above. Accordingly, the construction and assembly of the case components to this point allows for the uninterrupted flow of foam from the two injection points within a side panel space to expand and fill the gaps between the floor and subfloor, the top panels, and the far side panels. Various seams and access conduits may be masked or otherwise sealed as is conventional in the art to prevent the escape of foam from various designed openings within the panels.

Approximately 6 to 8 minutes after the foam has been introduced into the desired spaces, sufficient curing has occurred to permit the display case to be removed from the restraining blocks. Thereafter, the cured foam provides a strong adhesive bond between the overlapping interior panel structures. Further, the cured foam imparts a great deal of rigidity and strength to the overall structure which was previously lacking. In essence, the foaming steps provide the structural strength and the interconnecting means for the various components.

Thereafter, the internal shelving, deck, and any associated heating or cooling components may be installed. Where a refrigeration or heating assembly is to be inserted, applicants' preferred method of installation is to install the heating and cooling units, precharged with coolant where applicable, as a single functioning unit within the base. Connecting lines are then run to the interior of the display case to connect with the evaporator coil or heating unit. Additional accessories and external trim work are thereafter provided. The front display glass 50 and the rear doors 62 are installed last.

As seen in reference to FIG. 9, a standard refrigeration assembly may be separately configured and installed within a space defined beneath the lower floor panel 31 and between the inner leg walls. An elevated deck is positioned above a condenser element within the interior of the display case. Additional shelving features are also installed and as described and referenced earlier along with any decorative trim and finishing details.

A great deal of variation can be introduced into the above basic steps. An important aspect of the present invention is the ability to rapidly join prefabricated portions of the display case together. To this end, the use of a stitching tool to provide a rapid and low-strength bond between the panels has been found to improve the speed of the assembly process. While the resulting stitched structure lacks the inherent strength of other traditional fastening methods such as sheet metal screws, welds, or epoxy bonds, the end strength of the product is achieved by the resulting in situ foaming step. This step provides the necessary thermal insulation to the display case and, at the same time, secures the adjacent panel members in a strong, rigid manner. As a result, the display case can be rapidly constructed from prefabricated parts and joined together in a permanent manner with a minimum of additional time and materials.

An additional advantage of the present invention is that the injected foam core which forms between the defined spaces and gaps provides for a unitary, interconnected foam support. This arrangement of a single piece of cured foam results in a stronger, more rigid structure than if the gaps were individually foamed and formed no interconnections. Accordingly, the deli-case constructed according to the present invention provides for better weight and load distributions and results in a stronger, more durable case.

The above assembly process is particularly useful for refrigerated or heated display units, since such units require the thermal breaks and insulation which are provided by the assembly process. However, the present process is equally useful and economical for the construction of a dry case.

Although preferred embodiments of the invention have been described using specific terms, devices, and methods, such description is for illustrative purposes only. The words used are words of description rather than of limitation. It is to be understood that changes and variations may be made by those of ordinary skill in the art without departing from the spirit or the scope of the present invention, which is set forth in the following claims. In addition, it should be understood that aspects of the various embodiments may be interchanged, both in whole or in part. Therefore, the spirit and scope of the appended claims should not be limited to the description of the preferred versions contained therein.

That which is claimed is:

1. A method of forming a deli-style display case comprising:

supplying a substantially rectangular sheet metal panel;

stitching a metal front piece and a metal rear piece to a corresponding front edge and rear edge of the sheet metal panel and thereby forming a floor panel;

suspending the floor panel above a metal subfloor panel, the floor nesting within a receiving surface of the subfloor panel and defining a space therebetween;

stitching a first leg panel and a second leg panel to corresponding opposite sides of the subfloor panel;

stitching a first interior panel and a second interior panel to the respective sides of the floor panel, the floor panel and each side interior panel joined along a series or overlapping flange edges;

stitching an inner top panel along opposite sides of the top panel to a corresponding edge portion of the first side interior panel and the second side interior panel;

stitching a first side exterior panel and a second side exterior panel, each exterior side panel defining a plurality of substantially right angle flanges, to corresponding flange members collectively defined by the side interior panel and adjacent leg panel, the first side exterior panel and the second side exterior panel defining a spaced gap opposite the adjacent surface of the respective interior side panel and respective leg panel;

securing an exterior top panel opposite the interior top panel, said exterior top panel and said interior top panel defining a spaced gap therebetween, the top panel connected to an upper flange of the first and second exterior panels, wherein the spaced gap between the exterior top panel and the inner top panel is in open communication with the spaced gap defined between the respective interior side panels and respective exterior side panels, which is in further communication with the a spaced gap defined between the respective leg panels and exterior panels which is in further communication with the spaced gap defined between the floor panel and the subfloor panel;

injecting a urethane foam into at least one of the defined gaps, the injected foam flowing through and interconnecting the gaps and thereby filling the gaps with a single interconnected foam layer.

* * * * *